US010688642B2

(12) United States Patent
Shadwell et al.

(10) Patent No.: US 10,688,642 B2
(45) Date of Patent: Jun. 23, 2020

(54) HANDHELD FASTENER INSTALLATION GUIDE

(71) Applicant: OMG, Inc., Agawam, MA (US)

(72) Inventors: Peter J. Shadwell, Longmeadow, MA (US); Christopher Will, Big Lake, MN (US); David Mathieu, Colchester, CT (US)

(73) Assignee: OMG, Inc., Agawam, MA (US)

( * ) Notice: Subject to any disclaimer, the term of this patent is extended or adjusted under 35 U.S.C. 154(b) by 289 days.

(21) Appl. No.: 15/590,340

(22) Filed: May 9, 2017

(65) Prior Publication Data

US 2017/0326716 A1 Nov. 16, 2017

Related U.S. Application Data

(60) Provisional application No. 62/334,075, filed on May 10, 2016, provisional application No. 62/441,689, filed on Jan. 3, 2017.

(51) Int. Cl.
*B25C 5/16* (2006.01)
*B25B 23/04* (2006.01)
(Continued)

(52) U.S. Cl.
CPC ..... *B25C 5/16* (2013.01); *B25B 17/00* (2013.01); *B25B 19/00* (2013.01); *B25B 23/04* (2013.01);
(Continued)

(58) Field of Classification Search
CPC ..... B25B 23/00; B25B 23/04; B25B 23/06; B25B 23/005; B25B 23/045; B25C 1/005;
(Continued)

(56) References Cited

U.S. PATENT DOCUMENTS 3,524,576 A * 8/1970 Walton ..... B25C 1/041 227/136
3,811,171 A * 5/1974 Grube ..... B23P 19/062 29/56.6

(Continued)

FOREIGN PATENT DOCUMENTS

WO 9633051 A1 10/1996

OTHER PUBLICATIONS

International Search Report and Written Opinion dated Jul. 27, 2017 (International Patent Application No. PCT/US2017/031725).

(Continued)

*Primary Examiner* — Scott A Smith
(74) *Attorney, Agent, or Firm* — Alix, Yale & Ristas, LLP

(57) ABSTRACT

A handheld guide for advancing and installing a decking fastener with an elongate track with a rail and an advancement member. The advancement member carries a pivoting pawl with an engagement surface for advancing fasteners forward through the track to an installation position with a frontmost fastener aligned with a screw guide for driving a screw through the frontmost fastener. The rail has a ramp transitioning to a cliff and a lower ledge such that the frontmost fastener is maintained forward of the cliff above the ledge in the installation position. The pawl pivots to disengage from the fasteners when the advancement member moves rearwardly along the track.

22 Claims, 19 Drawing Sheets

(51) Int. Cl.

| | |
|---|---|
| ***B25B 23/08*** | (2006.01) |
| ***B25C 3/00*** | (2006.01) |
| ***B25C 1/18*** | (2006.01) |
| ***B25C 1/00*** | (2006.01) |
| ***B25B 17/00*** | (2006.01) |
| ***B25B 19/00*** | (2006.01) |
| ***B25C 5/10*** | (2006.01) |

(52) U.S. Cl.
CPC ..... *B25B 23/08* (2013.01); *B25C 1/003* (2013.01); *B25C 1/188* (2013.01); *B25C 3/006* (2013.01); *B25C 5/10* (2013.01); *B25C 5/1606* (2013.01); *B25C 5/1693* (2013.01); *B25C 1/005* (2013.01); *B25C 1/184* (2013.01); *B25C 5/1627* (2013.01)

(58) Field of Classification Search
CPC ..... B25C 1/001; B25C 1/003; B25C 1/184; B25C 1/188; B25C 5/1693; B25C 1/182; B25C 5/16; B25C 5/1627; B27F 7/006; B27F 7/13; F16B 15/00; F16B 15/08; F16B 27/00; F16B 31/028; F16B 43/00
USPC ..... 227/119, 120, 136, 138, 15, 18, 135; 221/197, 270, 232, 238, 71; 81/434, 81/57.37
See application file for complete search history.

(56) References Cited

U.S. PATENT DOCUMENTS 3,930,297 A * 1/1976 Potucek ..... B25B 23/045 29/431
3,961,408 A * 6/1976 Goodsmith ..... B23P 19/006 29/706
4,339,065 A * 7/1982 Haytayan ..... B25C 1/006 227/113
4,442,965 A 4/1984 Leistner
5,240,161 A 8/1993 Kaneko
5,332,141 A * 7/1994 Mukoyama ..... B25C 1/003 227/136
5,339,983 A * 8/1994 Caple ..... B23P 19/001 221/104
5,683,024 A 11/1997 Eminger et al.
5,738,266 A * 4/1998 Ogawa ..... B25C 1/003 227/119
5,897,046 A 4/1999 Oehri et al.
6,145,725 A * 11/2000 Omli ..... B25C 5/1693 227/120
6,363,818 B1 4/2002 Habermehl
6,499,642 B1 * 12/2002 Amada ..... B25C 1/005 227/119
6,736,303 B2 * 5/2004 Bruins ..... B25C 5/1693 227/110
6,779,700 B2 * 8/2004 Bruins ..... B25C 1/006 227/120
6,966,476 B2 * 11/2005 Jalbert ..... B25C 1/003 227/8
7,111,767 B2 * 9/2006 Losada ..... B25C 1/005 227/119
7,232,050 B2 * 6/2007 Omli ..... A41H 37/04 227/15
7,344,058 B2 * 3/2008 Bruins ..... B25C 5/1693 227/119
7,416,100 B2 * 8/2008 Fielitz ..... B25C 1/184 227/10
7,438,206 B2 * 10/2008 Kumayama ..... B25C 5/0242 227/120
8,240,232 B2 * 8/2012 Hale ..... B25B 23/00 81/434
8,657,173 B2 * 2/2014 Uejima ..... B25C 1/003 227/120
8,881,364 B2 * 11/2014 Sawdon ..... B23P 19/062 29/432.1
2003/0015565 A1 * 1/2003 Lee ..... B25C 5/1693 227/18
2006/0208027 A1 9/2006 Hagan
2010/0258608 A1 10/2010 Porth et al.

OTHER PUBLICATIONS

Supplementary European Search Report dated Jan. 14, 2020 for European Patent Application No. 17796680.1.

* cited by examiner

HANDHELD FASTENER INSTALLATION GUIDE

CROSS-REFERENCE TO RELATED APPLICATIONS

This application claims priority to U.S. Provisional Patent Application No. 62/334,075, filed on May 10, 2016, and to U.S. Provisional Patent Application No. 62/441,689, filed on Jan. 3, 2017, the entire contents of which is hereby incorporated by reference.

BACKGROUND

This disclosure relates generally to the installation of fasteners or clips for securing sheathing members (such as deck planks) to the joist or other structural members of a support structure. More particularly, the present disclosure relates to a handheld guide for use in installing hidden fasteners attached to one another in a collated strip form for use in installing sheathing made from planks having elongated side grooves.

Sheathing fasteners for planks with side grooves exist, and are well known in the relevant field. Recent advancements in the technology of fasteners have been made to allow for versatility, improved attachment strength and rigidity, as well as ease and quickness of installation, which advancements are disclosed in co-owned pending U.S. patent application Ser. No. 14/434,268 filed Apr. 8, 2015 (U.S. Application Publication No. 2015/0275951), the entire contents of which is incorporated herein by reference. U.S. Publication No. 2015/0275951 discloses a universal hidden deck fastener that may be attached to other similar fasteners in a front-to-rear alignment to form an attached collated strip. U.S. Publication No. 2015/0275951 also discloses a power driving tool, such as a compressed air tool, configured for automatic advancement and installation of hidden deck fasteners like those disclosed.

Many installers prefer to install such fasteners by hand, rather than using an automatic power driving tool or alternatively, by using a powered drill without a specially designed tool with an attached magazine for maintaining and advancing the deck fasteners automatically. Presently, these installers are required to handle each small fastener with their fingers place and maintain the fastener in the proper installation position prior to attachment, usually via a threaded fastener. Such a process is time consuming, lends itself to inconsistent fastener alignment and overall results due to the handheld positioning necessarily lending itself to variation. Thus, there is a need for a handheld installation guide for maintaining a fastener in place for attachment that provides substantial stability and consistency during the installation process, and more rapid, accurate and repeatable positioning of each fastener relative to the decking planks.

SUMMARY

In one embodiment, a guide for advancing and installing a fastener via an elongate securing member has an elongate track extending longitudinally from a rear end to a front end. The track includes a substantially central elongate rail that defines an advancement surface. An advancement member is engaged with the track and is longitudinally reciprocable. A screw guide is positioned proximate the front end of the track and defines a bore for receipt of an elongate securing member in a substantially upright position. The advancement member includes a pawl extending from a rear edge to a front edge. The front edge extends into the track and the pawl is maintained in a pivoting relationship relative to the advancement member about a substantially laterally extending axis. The advancement member includes a stop proximate the rear edge of the pawl. The stop defines a rotational extend of the pawl in a single rotational direction.

In another embodiment, a guide for advancing and installing a fastener via an elongate securing member has an elongate track extending longitudinally from a rear end to a front end with a substantially central elongate rail. A screw guide is positioned proximate the front end of the track and defines a bore for receipt of an elongate securing member in a substantially upright position in alignment with a frontmost fastener carried in the track. An advancement member is engaged with and longitudinally reciprocable along the track. The advancement member is biased rearward relative to the track and has an engagement surface for engaging a fastener positioned along the rail in an intermediate position. Fasteners positioned within the track on the rail engage with the advancement member when the advancement member is reciprocated forward along the track, causing the fasteners to slide along the rail in a forward direction from the intermediate position to a forward position with a frontmost fastener in an installation position substantially aligned with the bore. The advancement member disengages with fasteners positioned within the track when the advancement member is reciprocated rearward, thereby allowing the fasteners positioned with the track to remain in the intermediate or forward position.

In yet another embodiment of the guide for installing a fastener, an elongate track extends longitudinally from a rear end to a front end. A screw guide is positioned proximate the front end of the track and defines a bore for receipt of an elongate securing member in a substantially upright position. An elongate rail is positioned longitudinally within the track. The rail defines an advancement surface for fasteners positioned within the track. The advancement surface transitions from a substantially flat portion to a front cliff via an intermediate ramp portion. A ledge is positioned forward of the cliff. A frontmost fastener is maintained in an installation position longitudinally forward of the cliff with the attachment opening substantially aligned with the bore via an upward bias member.

DETAILED DESCRIPTION

Among the benefits and improvements disclosed herein, other objects and advantages of the disclosed embodiments will become apparent from the following wherein like numerals represent like parts throughout the several figures. Detailed embodiments of a handheld fastener installation guide are disclosed; however, it is to be understood that the disclosed embodiments are merely illustrative of the invention that may be embodied in various forms. In addition, each of the examples given in connection with the various embodiments of the invention which are intended to be illustrative, and not restrictive.

Throughout the specification and claims, the following terms take the meanings explicitly associated herein, unless the context clearly dictates otherwise. The phrases "In some embodiments" and "in some embodiments" as used herein do not necessarily refer to the same embodiment(s), though it may. The phrases "in another embodiment" and "in some other embodiments" as used herein do not necessarily refer to a different embodiment, although it may. Thus, as described below, various embodiments may be readily combined, without departing from the scope or spirit of the invention.

In addition, as used herein, the term "or" is an inclusive "or" operator, and is equivalent to the term "and/or," unless the context clearly dictates otherwise. The term "based on" is not exclusive and allows for being based on additional factors not described, unless the context clearly dictates otherwise. In addition, throughout the specification, the meaning of "a," "an," and "the" include plural references. The meaning of "in" includes "in" and "on.

Further, the terms "substantial," "substantially," "similar," "similarly," "analogous," "analogously," "approximate," "approximately," and any combination thereof mean that differences between compared features or characteristics is less than 25% of the respective values/magnitudes in which the compared features or characteristics are measured and/or defined.

Figure 1:
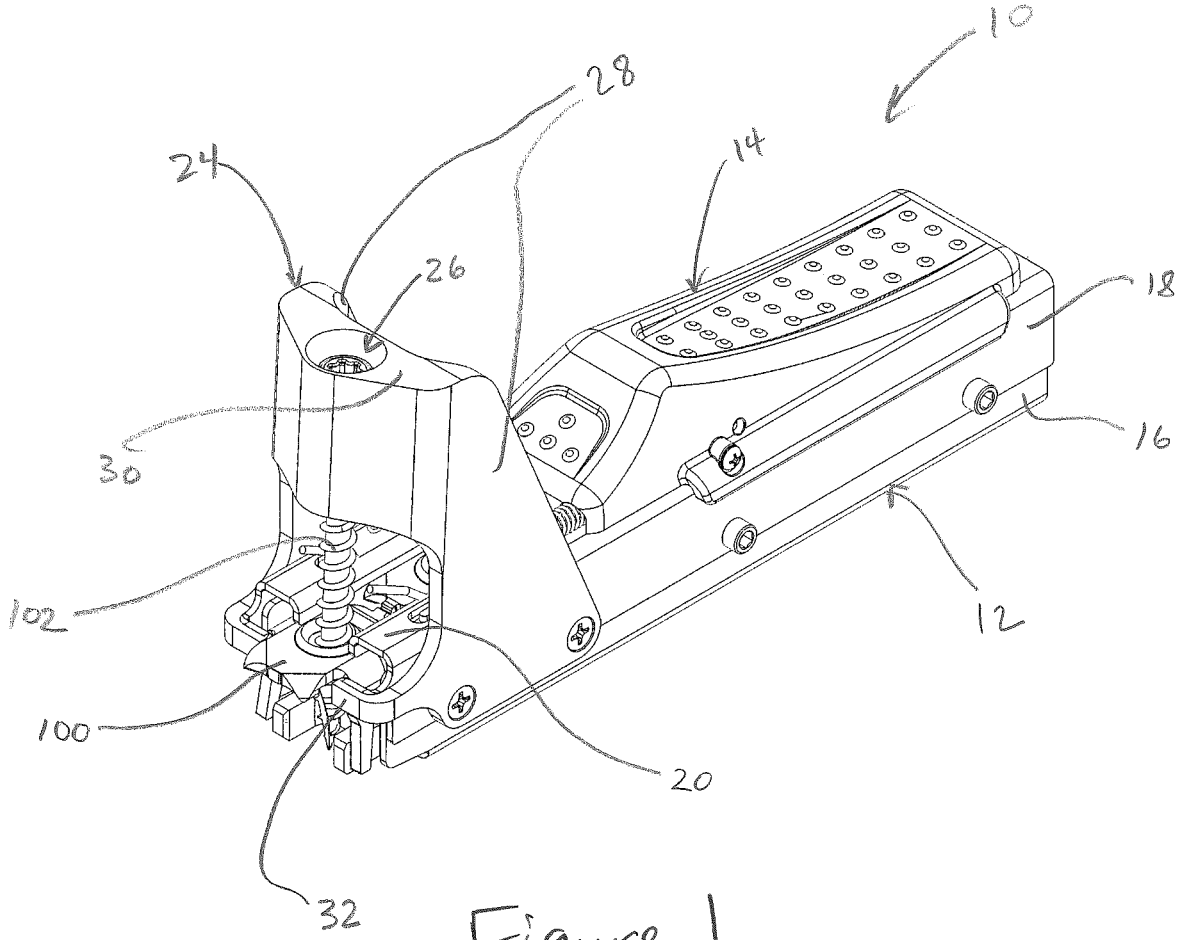
FIG. 1 is a top perspective view of an embodiment of the disclosed handheld installation guide with a series of preset fasteners loaded.

FIG. 1 shows an embodiment of the disclosed handheld guide 10 with a series of collated fasteners 100 loaded within its track 12 for installation. The guide 10 generally comprises an elongate track 12 extending longitudinally from a rear end to a front end, and an advancement member 14 reciprocable forward and rearward along the track 12 in a sliding relationship. The track 12 has a generally U-shaped lower member 16 that includes a central elongate rail 17 (see FIG. 7) and an upper member 18 defining shoulders 20 upwardly spaced from the upper surface of the rail 17. As shown, the opposite shoulders 20 extend longitudinally with the track and define a slot 22 therebetween. In this embodiment, the shoulders 20 are bent downward at their respective inner edges to form a substantially U-shaped cross sectional shape in the longitudinal direction. This configuration of the shoulders 20 assists in guiding the fasteners through the track by contacting the top surfaces of the fasteners 100 in operation, however, this is not a necessary characteristic in the inventive guide. In practice, the slot 22 accommodates and helps to maintain the advancement member 14 in alignment on the track 12 as it is reciprocated rearward and forward during operation and installation. Also shown in FIG. 1 is the screw guide 24. The screw guide 24 has a substantially upright cylindrical bore 26 configured to accommodate an attachment screw 102 and guide the screw distal end through an opening in the top of the frontmost fastener 100 for installation. In the depicted embodiments, the track 12 comprises a lower member 16 joined to an upper member 18 via screw attachment, however embodiments exist wherein the track is a single unit or the upper and lower members are attached to one another via other known techniques such as welding.

The screw guide 24 is positioned toward the distal end of the guide 10 rigidly attached to the track 12. The screw guide 24 includes a pair of legs 28 laterally spaced from one another extending obliquely (perpendicular in some embodiments) upward from the track 12 with a bridge 30 extending therebetween. The bridge 30 defines a substantially cylindrical screw bore 26 with an optionally chamfered upper surface for receipt of a screw 102. The bore 26 is angled slightly rearward, which has been found to assist optimal driving of a screw 102 and cooperation with the fastener 100 during attachment to a joist and sheathing. A preferred embodiment of the screw guide 24 includes a bore 26 angled rearward at between approximately 1° and 10°, and even more preferably at approximately 3°, relative to a line perpendicular (upright) to the longitudinally extending track 12. The rearward angle of the bore 26 assists in at least two significant ways: (1) preventing a drill bit from contacting the sheathing member if the bit slips out from the screw drive during installation; and (2) angular installation of the screw naturally moves the fastener forward pressing it into a tight mating with the sheathing member that it is attaching to the joist.

Figure 2:
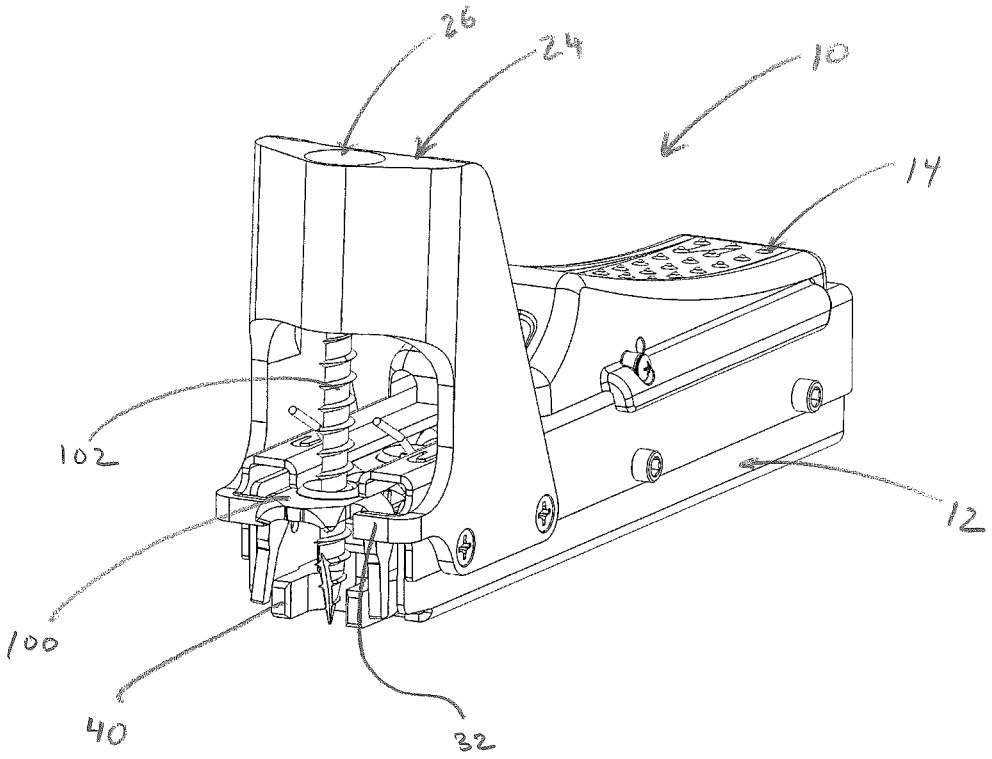
FIG. 2 is a front perspective view of guide from FIG. 1.
Figure 3:
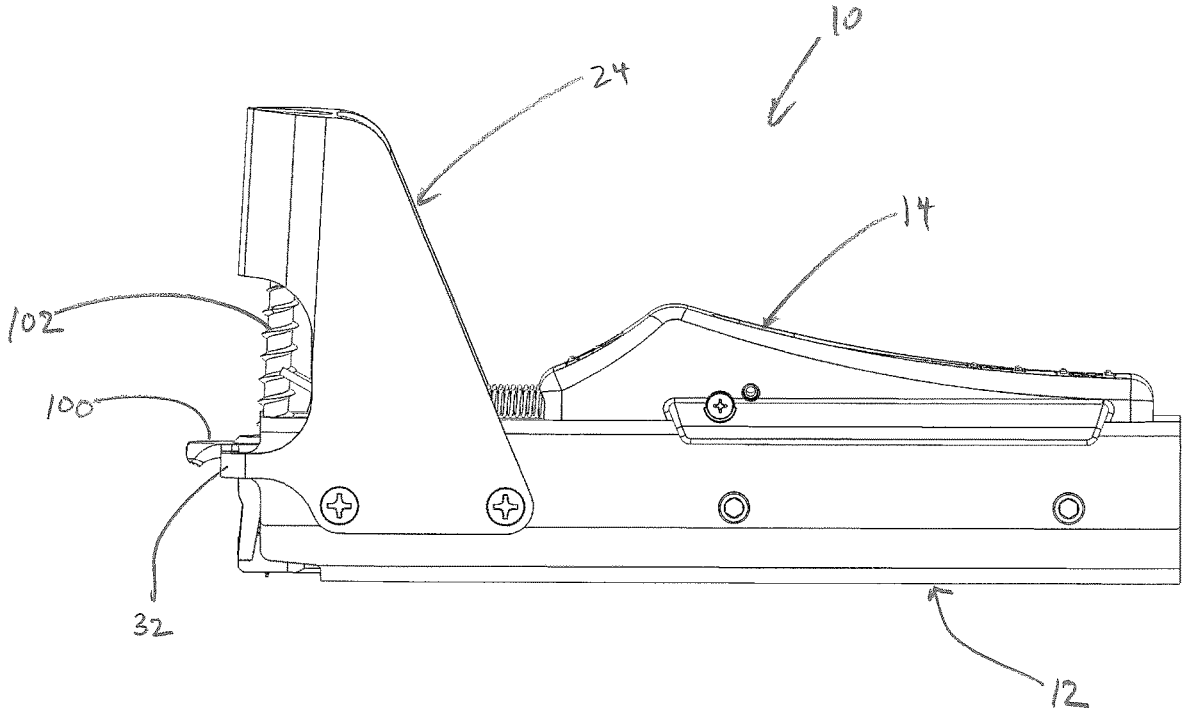
FIG. 3 is a side elevation view of the disclosed guide.
Figure 4A:
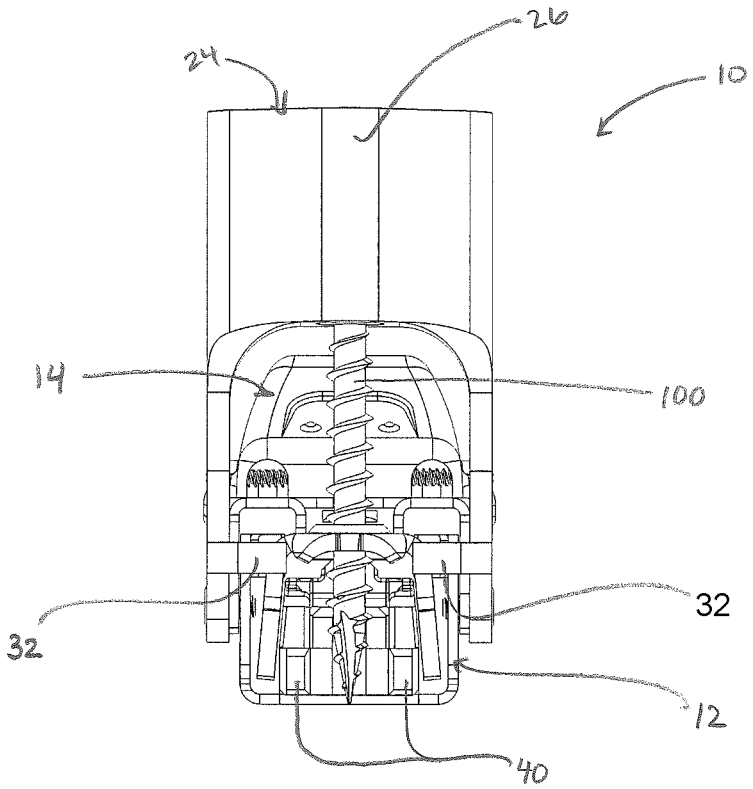
FIG. 4A is a front elevation views of the disclosed guide.
Figure 4B:
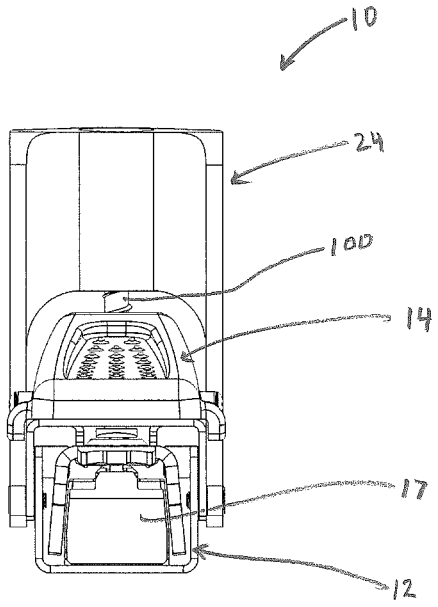
FIG. 4B is a rear elevation view of the disclosed guide.
Figure 5:
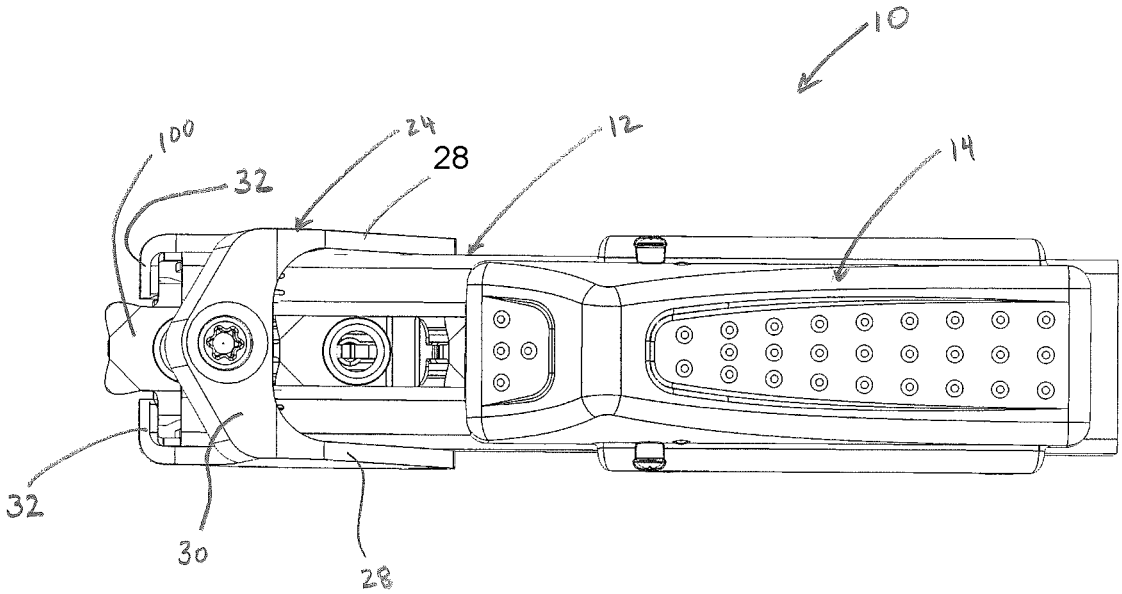
FIG. 5 is a top elevation view of the disclosed guide.

Also shown in numerous Figures are front shoulders 32 at the distal end of the guide 10. Each shoulder 32 extends inward from an opposite outer lateral side with lateral spacing therebetween and is positioned forward of the rail 17. The primary purpose of the spacing is for accommodating the front portion of the frontmost fastener 100 in the installation position. In FIGS. 1 and 2, for example, the frontmost fastener 100 can be seen with its front portion extending through the spacing between the opposite shoulders 32. The shoulders 32 are configured to provide a forward stop against the opposite legs of the frontmost fastener 100 at a desired longitudinal position with the attachment hole on the top surface of the fastener aligned with the bore 26 of the screw guide 24 for receipt of the screw 102, and ultimately attachment of the frontmost fastener 100 to a joist and sheathing. In the embodiment depicted in the Figures, the front shoulders 32 are depicted as extending integrally from a front portion of the screw guide 24 in the laterally inward direction, however, the front shoulders 32 may also be formed as members extending from the upper or lower portions, 18 and 16, of the track 12 or as separately attached elements. The front shoulders 32 are positioned to cooperate with distal elements of the track 12, including the torsion spring 35, central rail 17 and shoulders 20 to maintain the frontmost fastener 100 in the optimal position relative to the screw guide 24 (discussed in detail below).

Figure 8:
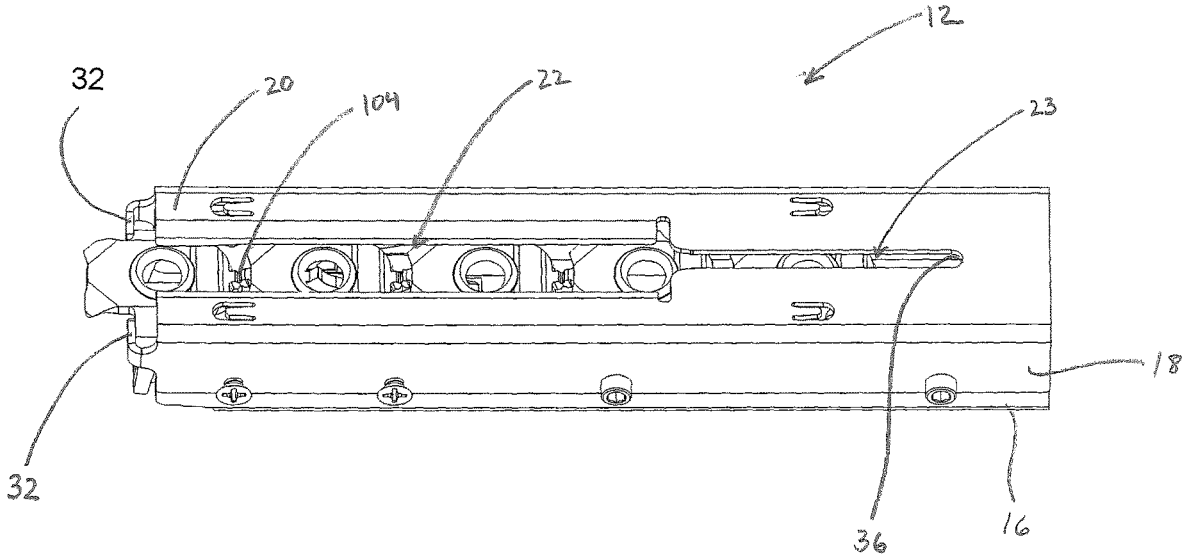
FIG. 8 is a top perspective view of the track of the guide with a collated series of fasteners loaded an all other elements removed.
Figure 9:
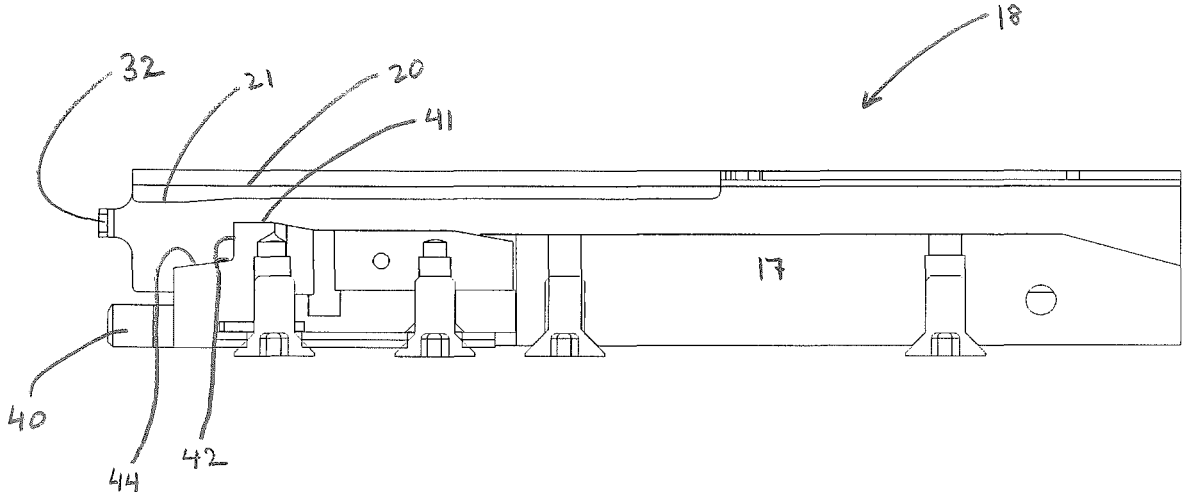
FIG. 9 is a cross sectional view of the track portion of the guide with all other elements removed.

FIG. 8 shows the track 12 with the advancement member 14 and screw guide 24 removed. As depicted, the upper member 18 includes inwardly extending upper shoulders 20 defining a slot 22 therebetween. The upper member 18 and lower member 16 are attached to each other rigidly via welding, soldering, external fastener, or similar. In operation, the rearmost boundary of the slot 22 acts as a physical stop for the advancement member 14, preventing further rearward motion past it. In a preferred embodiment, the advancement member 14 is biased rearwardly by a compression spring or similar. With reference to FIG. 9, it can be appreciated that the bottom edges 21 of shoulders 20 of the upper member 18 transition downward toward the front end of the track 12. This configuration is useful in cooperating with a torsion spring 35 with legs that bias the frontmost fasteners 100 upward against the shoulders 20 to maintain the frontmost fastener 100 in optimum position for attachment with a screw 102 through the screw guide 24. The cooperative legs of the torsion spring 35 and the downwardly transitioned edges 21 of the shoulders 20 are particularly useful in maintaining a last fastener 100 in a collated series tightly in the proper position for attachment without additional fasteners being within the track 12.

Figure 6:
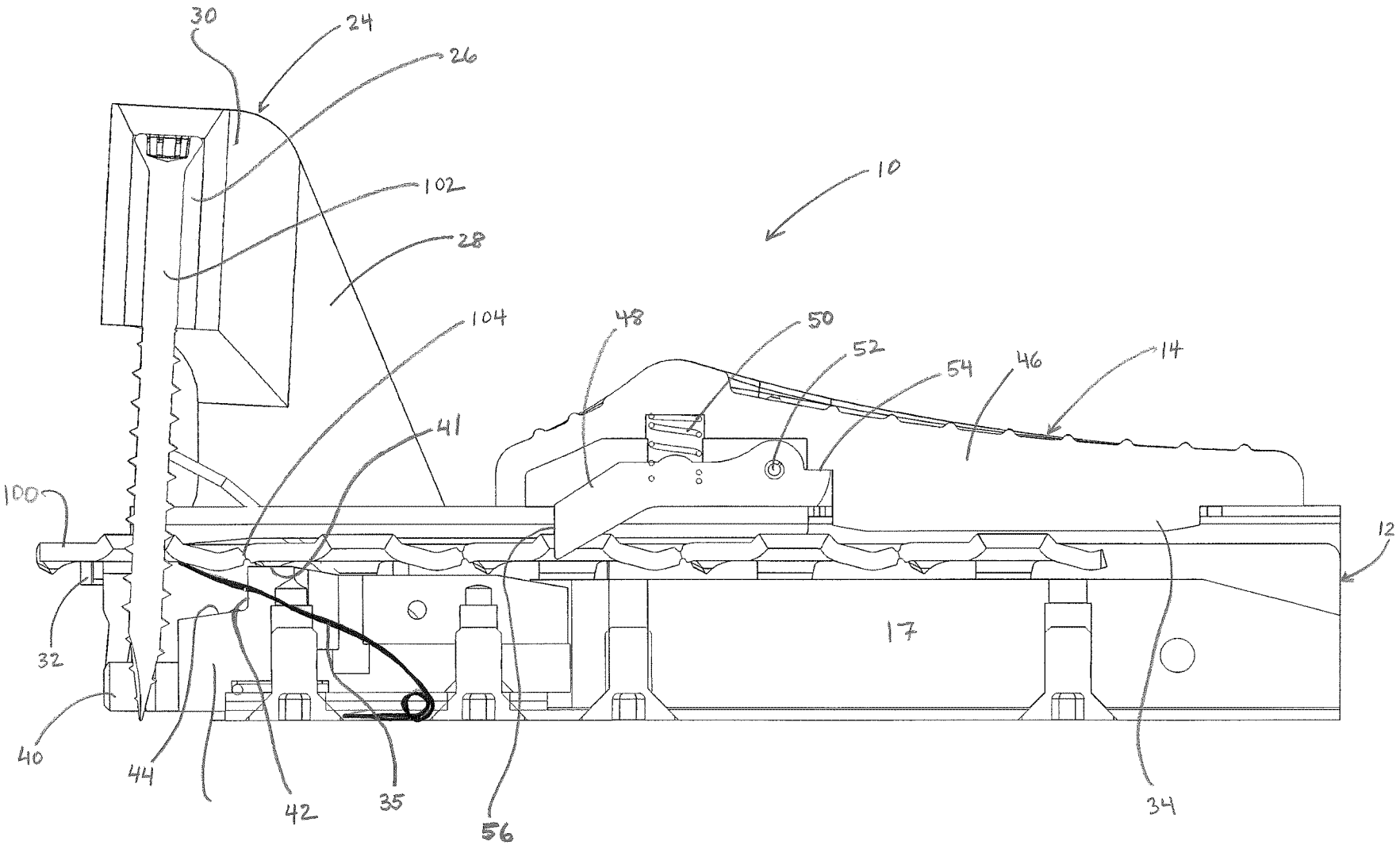
FIG. 6 is a cross sectional view of the disclosed guide loaded with a collated series of fasteners and a screw for attachment.

With reference to the cross section view of FIG. 6, the advancement member 14 includes a body 46 and a pawl 48 under bias from a compression spring 50 in the downward direction toward its front end. The pawl 48 is pivotable about a substantially laterally extending axis 52 located rearward of the downward spring bias. The pawl 48 has an upper rear edge 54 that abuts an upper surface in the body 46 to block the pawl 48 from pivoting past a preferred position. Notably, in a preferred embodiment, the pawl 48 and cooperating elements are configured to maintain the pawl in position with its front edge 56 substantially perpendicular to the longitudinally extending track 12 (i.e., the front edge of the pawl is substantially vertical when the track is horizontal in a typical use of the guide 10). A central elongate brace 34 projects downward from the top inner surface of the advancement member body 46. By extending downward into and cooperating with the narrowed rearward portion 23 of the slot 22, the brace 34 maintains the advancement member 14 in alignment with the track 12 and prevents the advancement member 14 from disengaging from the rear of the track 12 by abutting the slot rear end 36 (see FIG. 8). The brace 34 can also be configured to cooperate with the contour of the slot 22/23 to provide lateral alignment while reciprocating the advancement member 14 along the track 12. In a preferred embodiment, the brace 34 includes a pair of elongate laterally extending flanges at its terminal end which are positioned below the edges in the upper member 18 to maintain the advancement member 14 vertically with respect to the track 12. The advancement member 14 is maintained within the track in the forward direction via abutment with the rear edges of the screw guide legs 28.

As can be appreciated in FIG. 6, the pawl 48 allows rearward reciprocation of the advancement member 14 relative to the collated strip of fasteners 100 via pivoting clockwise against the bias from the spring 50. However, the substantially perpendicular contour of the front edge 56 relative to the strip of fasteners 100 catches on a portion of the top surface or edge of an intermediate fastener 100 to move the strip of fasteners 100 forward when reciprocating the advancement member 14 forward. The strip of fasteners is pushed forward via the pawl 48 until the frontmost fastener 100 is stopped by the front shoulders 32, thereby positioning the frontmost fastener for attachment. In a preferred embodiment, the advancement member 14 automatically reciprocates rearward under spring bias upon release of manual force in the forward direction and is allowed to travel freely relative to the remaining fasteners in the strip by operation of the pawl 48 pivoting about its axis 52.

As shown most clearly in the cross sectional view of FIG. 6, embodiments of the guide 10 includes an elongate central rail 17 extending longitudinally within the track 12. The rail 17 is configured to provide a support surface for fasteners 100, and in the case of the disclosed U-shaped fasteners, provide a degree of lateral support. As shown, the disclosed rail 17 transitions slightly upward via a ramp 41 toward its distal end (the front end of the track), before abruptly transitioning via a cliff 42 to a lower support ledge 44. The ramp 41 assists in first transitioning the frontmost fastener 100 into the desired position with the torsion spring 35 biasing it upward against the upper portion shoulder edges 21 for attachment, and ultimately assists in detachment of the frontmost fastener from the adjacent attached fastener at the tail-nose position (104 in FIGS. 6 and 8). Typically, the distal portion with the ramp 41, cliff 42 and ledge 44 is formed integrally with the rear substantially flat portion of the rail. However, in one embodiment, the distal portion of the rail 17 is formed on the surface of an anvil element having improved hardness qualities (formed of iron or steel, for example). The ledge 44 can also include a slight downwardly angled surface, configured specifically to abut the rear lip of the frontmost fastener to prevent overdriving of the screw 102 and fastener 100 into the sheathing and joist during attachment. As can be seen most clearly in the embodiment of the guide 101 in FIG. 16 and the isolated drawings in FIGS. 19 and 20, a substantially flat plateau 145 can be positioned intermediate the ramp 141 and cliff 142. In a typical use, the plateau 145 provides a support surface for a fastener directly behind the frontmost fastener in the series and aids disengagement of the frontmost fastener during installation. While the plateau 145 is best viewed in FIGS. 16, 19 and 20, the same or similar ramp to plateau to cliff to ledge transition can be employed within the rail in any of the previously disclosed embodiments, and is indeed shown under a deck fastener 100 in the guide 10 of FIG. 6.

The ramp 41/cliff 42/ledge 44 (or 141, 142, 144 in the later depicted embodiment) configuration at the distal end of the track provides at least two significant benefits: (1) a more robust and centered bearing surface abutting the bottom of the front fastener in the collated series during installation, and (2) clearance between the frontmost fastener and the adjacent trailing fastener for aiding in breaking the frontmost fastener off during installation. Moreover, as described above, the upward bias member 35 allows a singular deck fastener 100 (for example, a last fastener in a collated series) to be securely maintained longitudinally forward of the cliff 42 aligned with the bore 26 of the screw guide 24 in position for installation. The clearance provided by the cliff 42 also allows side-to-side reciprocation or "wiggling" of the guide 10 to aid in breaking off the frontmost fastener 100 in the event that the attachment of the frontmost fastener to the joist does not disengage it from the series of fasteners (at the tail-nose collation point 104 shown in FIGS. 6 and 8).

Figure 7:
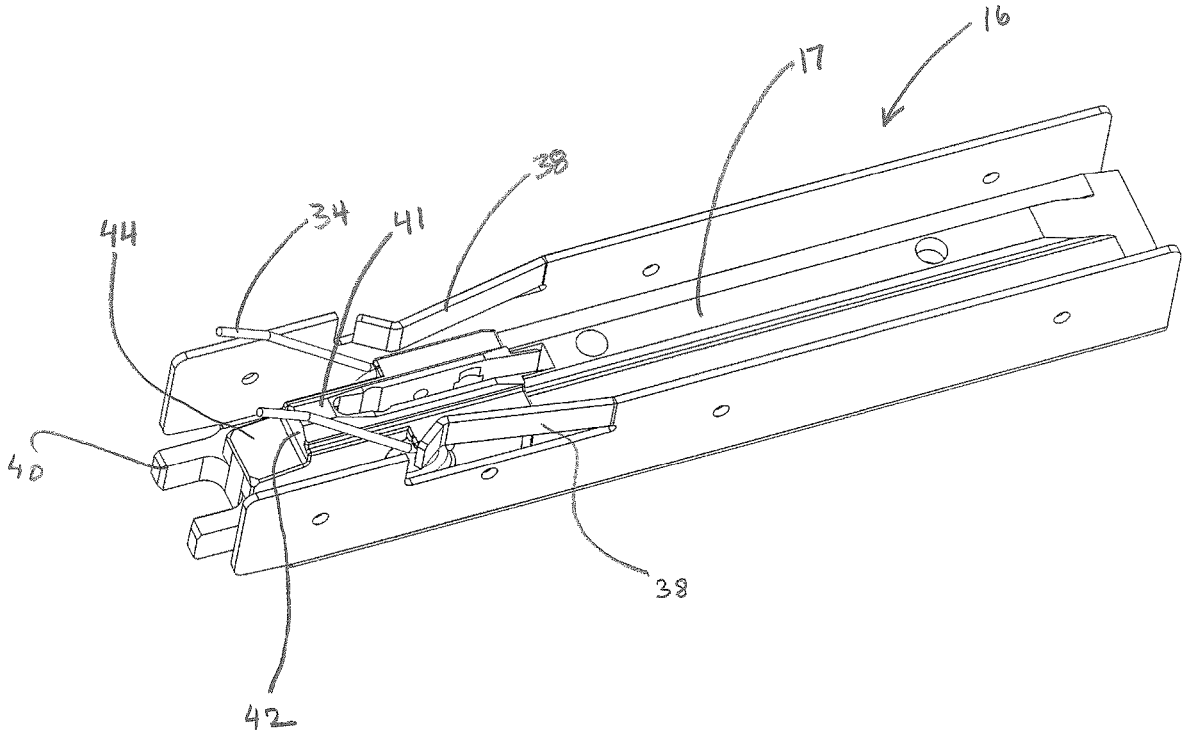
FIG. 7 is a top perspective view of the bottom portion of the track of the guide with all other elements removed.

Also exemplified in FIG. 7 is the concave distal-most protrusion 40 of the rail (or anvil). As shown, the protrusion 40 has a concave distal edge (or U-shaped front edge) shaped to accommodate the screw 102 during attachment (i.e., driving the screw in the front fastener downward). The protrusion 40 is sized and shaped to be placed in abutment against a bottom portion of a sheathing member when a user is installing a fastener 100 onto a sheathing member and joist. In this manner, the protrusion is sized specifically to allow positioning of the frontmost fastener 100 in the preferred longitudinal position relative to the sheathing member for installation.

Figure 15:
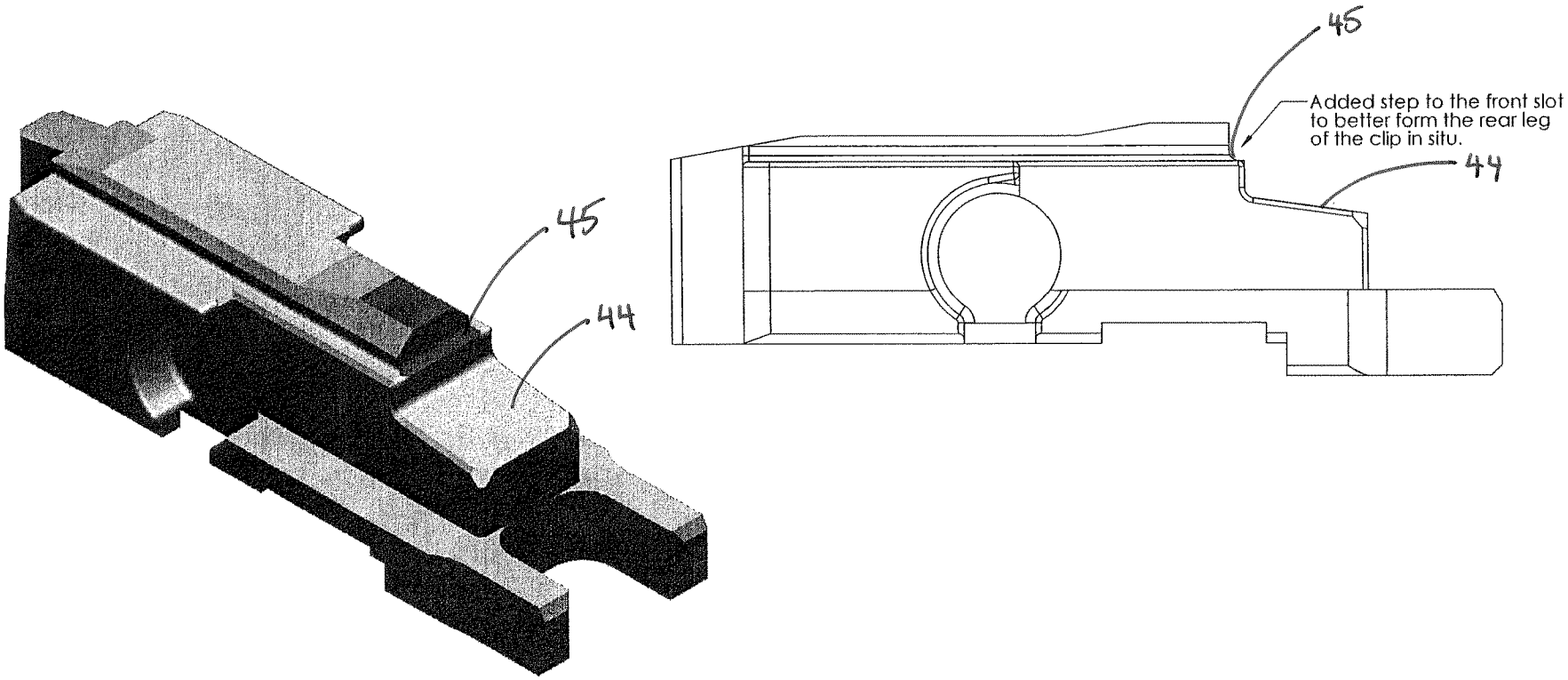
FIG. 15 shows an alternate embodiment of an anvil for use in the disclosed installation guide.

Shown in FIG. 15 is an alternate embodiment of an anvil element, including an intermediate step 45. The intermediate step has been shown to provide a more gradual or step-wise breaking off of the frontmost fastener, which in turn provides improved operating life of the drill bit. The intermediate step 45 configuration at the front end of the rail can be employed in any of the embodiments of the guide disclosed herein.

FIG. 7 shows the lower track portion 16 and selected inner elements of an embodiment of the track 12. As can be seen, in this embodiment, the laterally opposite walls of the lower track portion 16 each includes a finger 38 extending into the interior of the track 12. As shown, the fingers 38 are each formed as an inward bend from the respective lateral wall of the lower track portion. Also shown in FIG. 7 is the torsion spring 35 with legs positioned to bias the frontmost fastener 100 in the upward direction in the installation position aligned with the screw guide 24. As discussed, in operation of the guide 10, the torsion spring 35 biases the frontmost fastener 100 against the edge 21 of the upper portion shoulder 20 to maintain it in optimal alignment with the screw guide 24 for attachment. The fingers 38 are bent and positioned to allow forward movement of fasteners 100 in a collated series through the track 12, but prevent rearward movement by acting as a stop against a portion of a fastener 100 in the rearward direction. In one embodiment, the front edges of the fingers 38 abut the rear edges of the legs of the fastener that is rearwardly adjacent to the frontmost fastener such that the two frontmost fasteners are prevented from moving rearward past the front edges of the fingers 38. The depiction in FIG. 7 shows an embodiment wherein the fingers 38 each includes a flange formed as a bend in its terminal edge, however, this is nonlimiting. Other preferred embodiments include fingers 38 with straight front edges extending into the inner portion of the track. Preferably, the lower member 16 has a bottom surface that is substantially flat and coplanar with the bottom surface of the distal protrusion 40 to allow the guide to be placed flush on the surface of the joist during attachment of a fastener. Still additional preferred embodiments exist without fingers like those shown as reference numeral 38. These embodiments include a straight longitudinally extending track 12 with flat side panels without interruptions or extensions.

Preferred dimensions of the installation device 10 are between approximately 3.5 and approximately 5 inches in length from the front edge of the rail protrusion 40 to the rear end of the track 12, and more preferably approximately 4.25 inches long; between approximately 0.75 to approximately 1.5 inches wide, and more preferably approximately 1.0 inches wide. The length dimension has shown to be preferable because it is less than the width dimension of a typical sheathing member (approximately 5.5 inches), and therefore allows the tool to be placed and used in tight locations, including attaching a penultimate sheathing member in a decking structure leading up to a backing or similar surface. Additionally, the width dimension has shown to be preferable at least due to the fact that a typical joist is approximately 1.5 inches wide, so the entire device 10 is fully supported on the upper surface of the joist during installation of fasteners.

FIGS. 10-13 show a representative attachment of a decking plank P to a joist J with the fastener 100. In these stepwise representative drawings, only the front fastener 100 is shown with the guide 10 and rear fasteners in the series removed for clarity.

Figure 10:
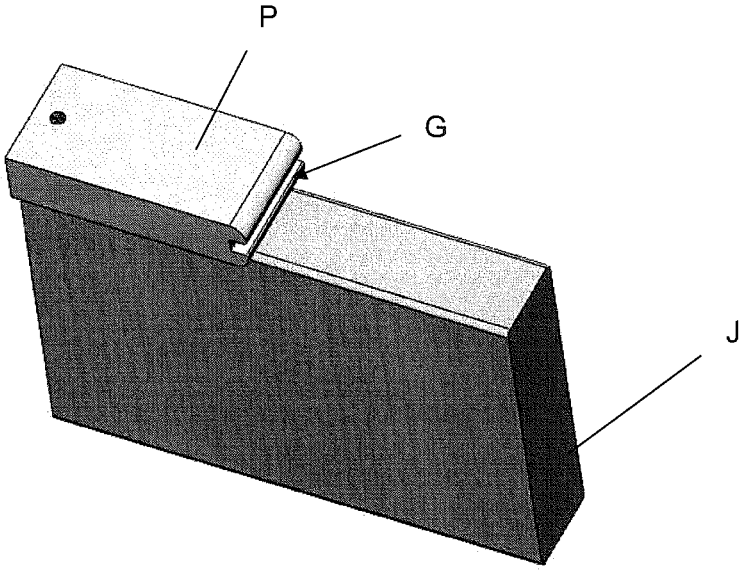
FIGS. 10-13 display the representative steps of a typical assembly of a decking structure with fasteners similar to those for use with the disclosed guide.
Figure 11:
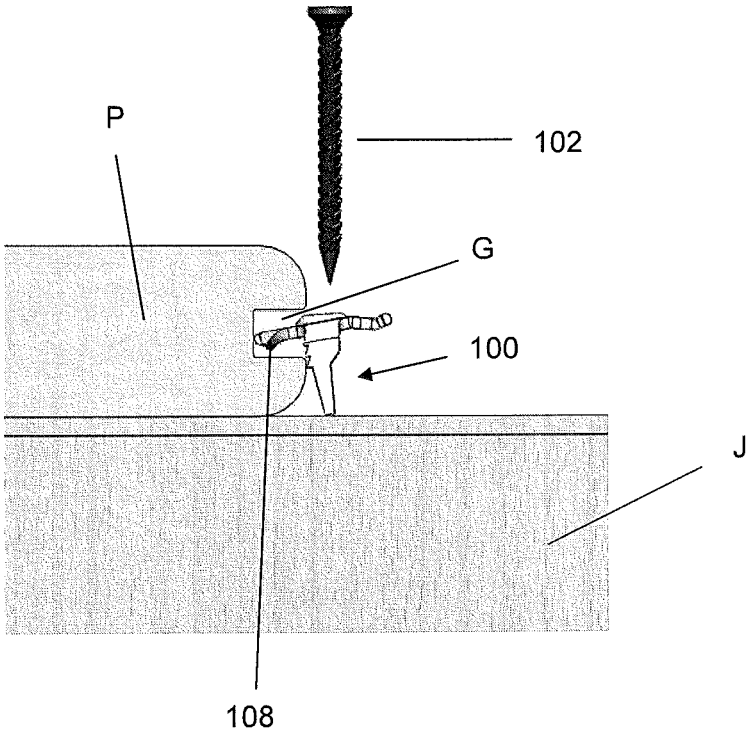

FIG. 10 shows a section of a first grooved decking plank P on a support, such as a joist J (also in sectional view). As represented in FIG. 11, the front end of the fastener 100 with teeth 108 is navigated into the plank groove (via the guide 10, though the guide is removed from FIGS. 10-13). An elongate securing member with a shank (i.e., screw or similar) 102 is driven through the attachment opening in the top surface of the fastener 100 and into the joist J (via the angled screw guide 24). The downward force of the securing member drives the legs of the fastener to penetrate into the joist surface. The downward penetration of the legs is stopped by the lower surface of the fastener body abutting or mating substantially flush with the lower nub of the decking plank, as shown best in FIG. 12. As noted above, if driving of the securing member through the front fastener into the joist fails to disengage the front fastener from the attached series of fasteners loaded into the track 12, the guide 10 may be pivoted side-to-side to break the tail-nose attachment.

Figure 12:
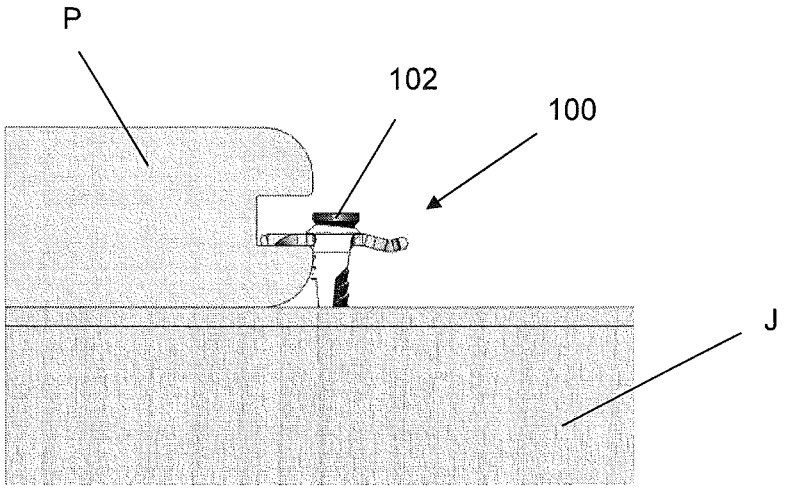
Figure 13:
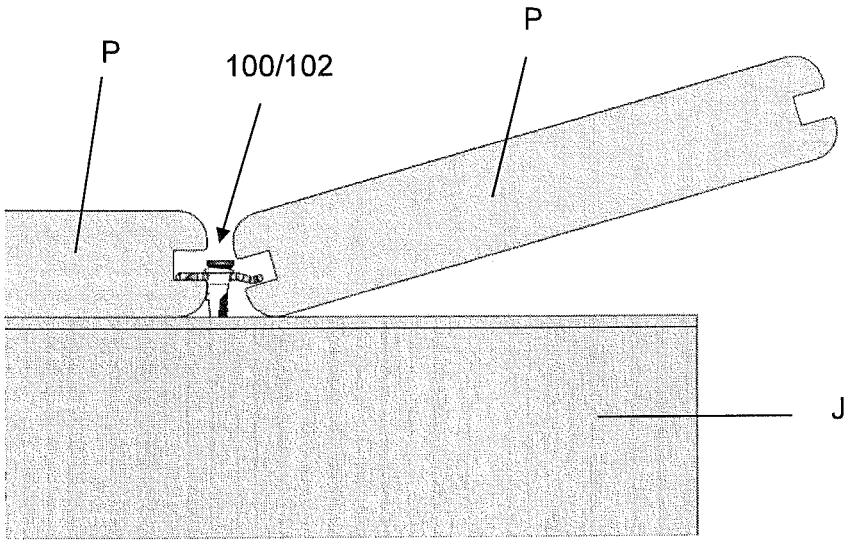
Figure 14:
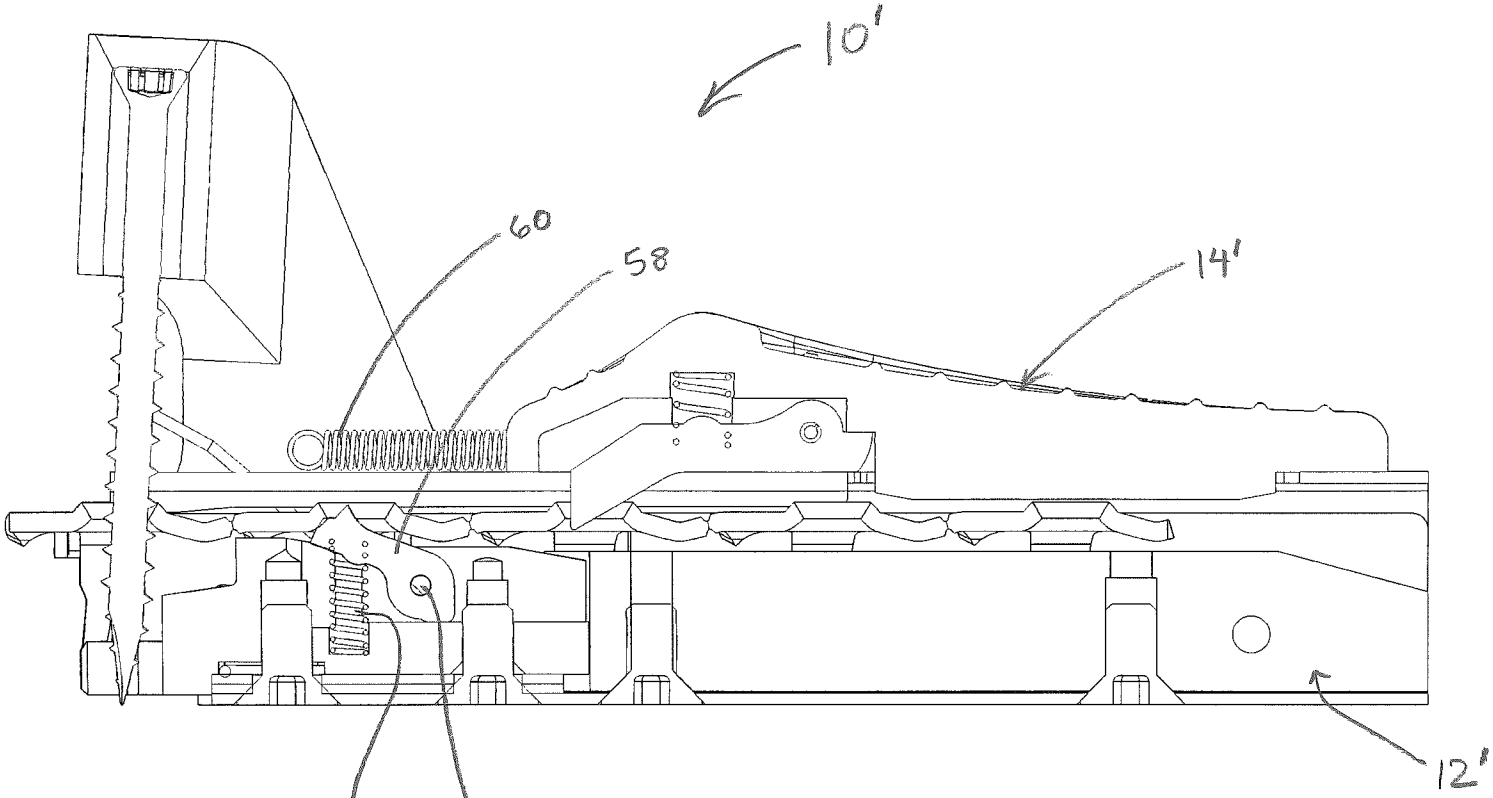
FIG. 14 shows a cross sectional view of an alternate embodiment of the installation guide 10.

FIG. 12 shows the fastener installed in groove of a decking plank, attaching the plank P to the joist J. FIG. 13 depicts installation of a trailing decking plank by sliding under the rear lip of the attached fastener 100. FIG. 14 shows the installed fastener holding the first and trailing decking planks via compressive downward force against the joist J, without requiring additional tightening or penetration of the decking planks. A decking structure is assembled by attaching third, fourth, etc. planks via the same process.

Another embodiment of the installation device 10' is shown in the cross sectional view of FIG. 14. This embodiment of the device 10' utilizes a reverse pawl 58 forward of the pawl 48 in the advancement member 14. As shown, the reverse pawl 58 is biased in the upward direction (opposite of the direction of bias on the pawl 48) via a compression spring 59. The configuration of the edges of the reverse pawl 58 allows the fasteners 100 to move forward past the reverse pawl 58 via counterclockwise rotation about the axis 62, but blocks rearward movement of the fasteners 100 relative to the reverse pawl 58. The reverse pawl 58 can be utilized in addition to or in place of the locking fingers 38. An additional advantage of the reverse pawl 58 is that the upward spring bias inherently biases the front fasteners in the upward direction as well. This phenomenon has been shown to be advantageous because it prevents overlap of successive fasteners when inserting a new strip of fasteners into the track 12'. Finally, the FIG. 14 embodiment shows a compression spring 60 that biases the advancement member 14' forward instead of rearward like in the prior embodiments. Notably, the forward biasing spring 60 can be employed in any of the preceding embodiments; not only in combination with the reverse pawl 58.

Figure 16:
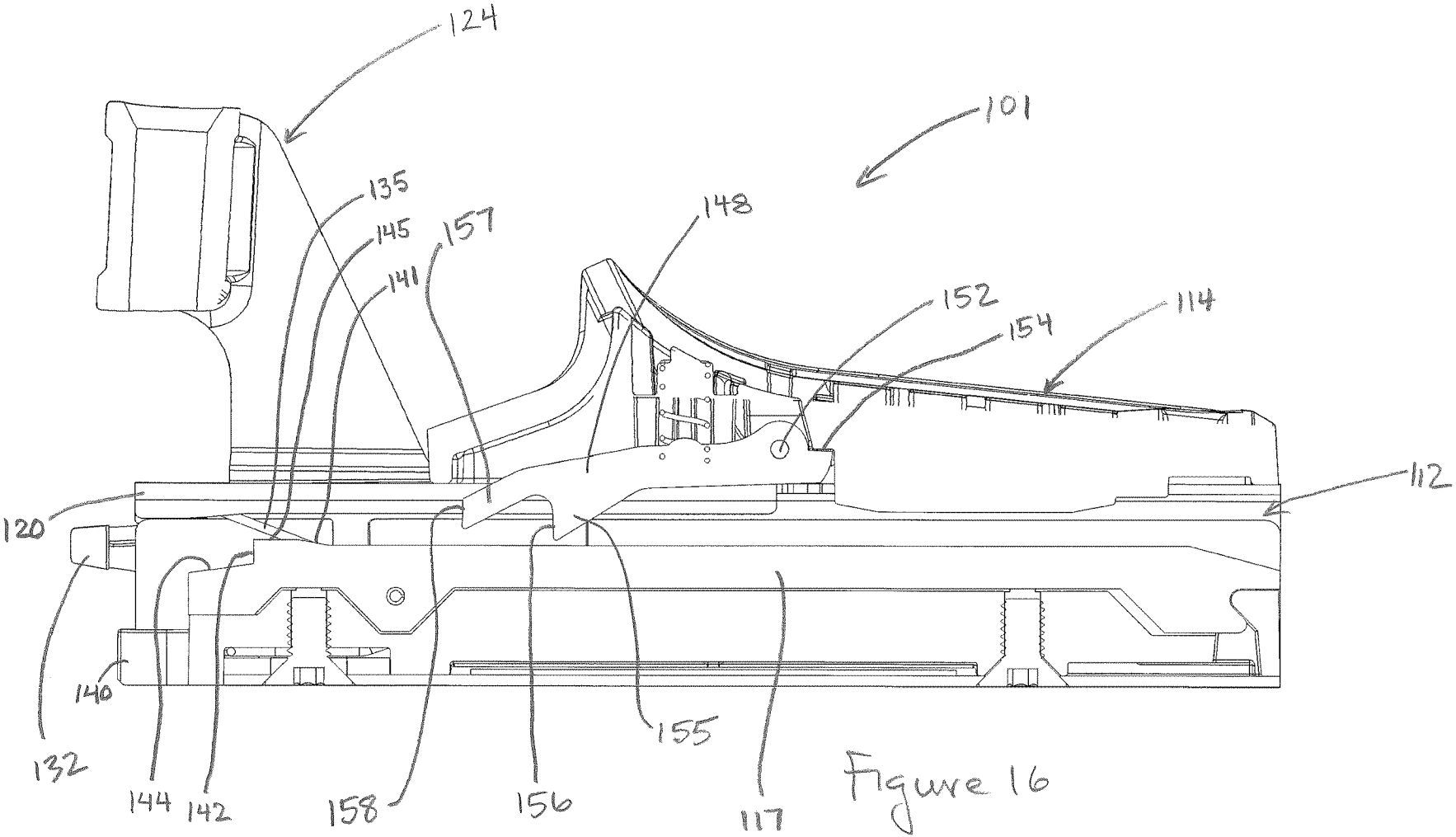
FIG. 16 shows a cross-sectional view of an alternate embodiment of the disclosed handheld installation guide.

FIG. 16 shows another preferred embodiment of the disclosed handheld installation guide 101. As can be seen, many of the elements are substantially similar or even identical to counterpart elements from the earlier embodiments of the guide, 10 and 10'. The primary divergence from the earlier embodiments is that guide 101 includes a dual-prong pawl 148 in place of the single prong pawl 48 of the FIG. 6 embodiment. The pawl 148 has a rear primary trailing prong 155 with a flat front edge 156. A leading prong 157 extends obliquely downward from the top edge forward of the trailing prong front edge 156 and also defines a substantially flat front edge 158. When the pawl 148 lays substantially flat (as shown in FIG. 16), the front edge 156 of the trailing prong 155 extends downward further than the front edge 158 of the leading prong 157 so that the trailing prong is closer to the rail 117. Like the earlier embodiments that feature a single prong pawl, the dual-prong pawl 148 is held relative to the advancement member 114 via a pin 152 that defines a substantially lateral axis of rotation or pivot. Forward of the pin 152, the pawl 148 is biased downward by a compression spring 150, also much like the pawl 48 shown in FIG. 6. Like the prior embodiments, the pawl 148 has an upper rear edge 154 that abuts surface in the advancement member 114 to stop the pawl 148 from pivoting past a preferred position (depicted in FIG. 16). In other words, the stop surface in the advancement member 114 (or 14) defines the rotational extent of the pawl 148 (or 48) in a single direction (i.e., counterclockwise in the views of FIGS. 6 and 16).

Figure 17:
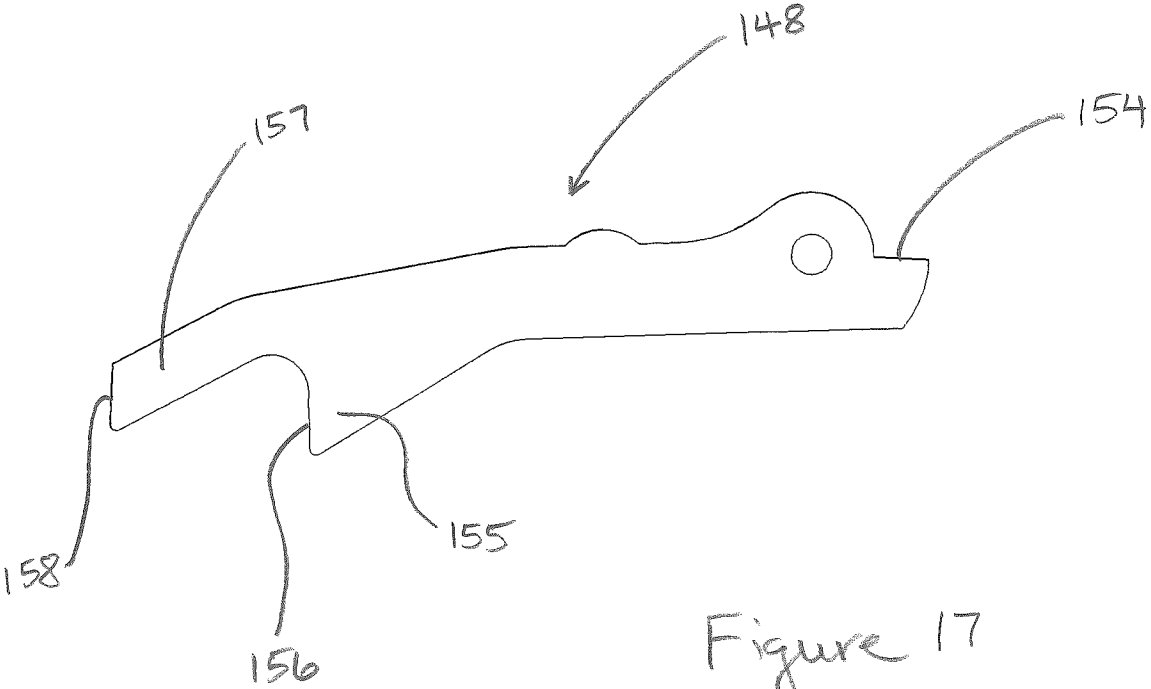
FIG. 17 shows an elevation view of an alternative dual-prong pawl employed in the embodiment of FIG. 16.

The above-described elements and characteristics of the dual-prong pawl 148 for use in any of the disclosed embodiments of the handheld installation guide can be seen in detail in the isolated view of FIG. 17.

Figure 18:
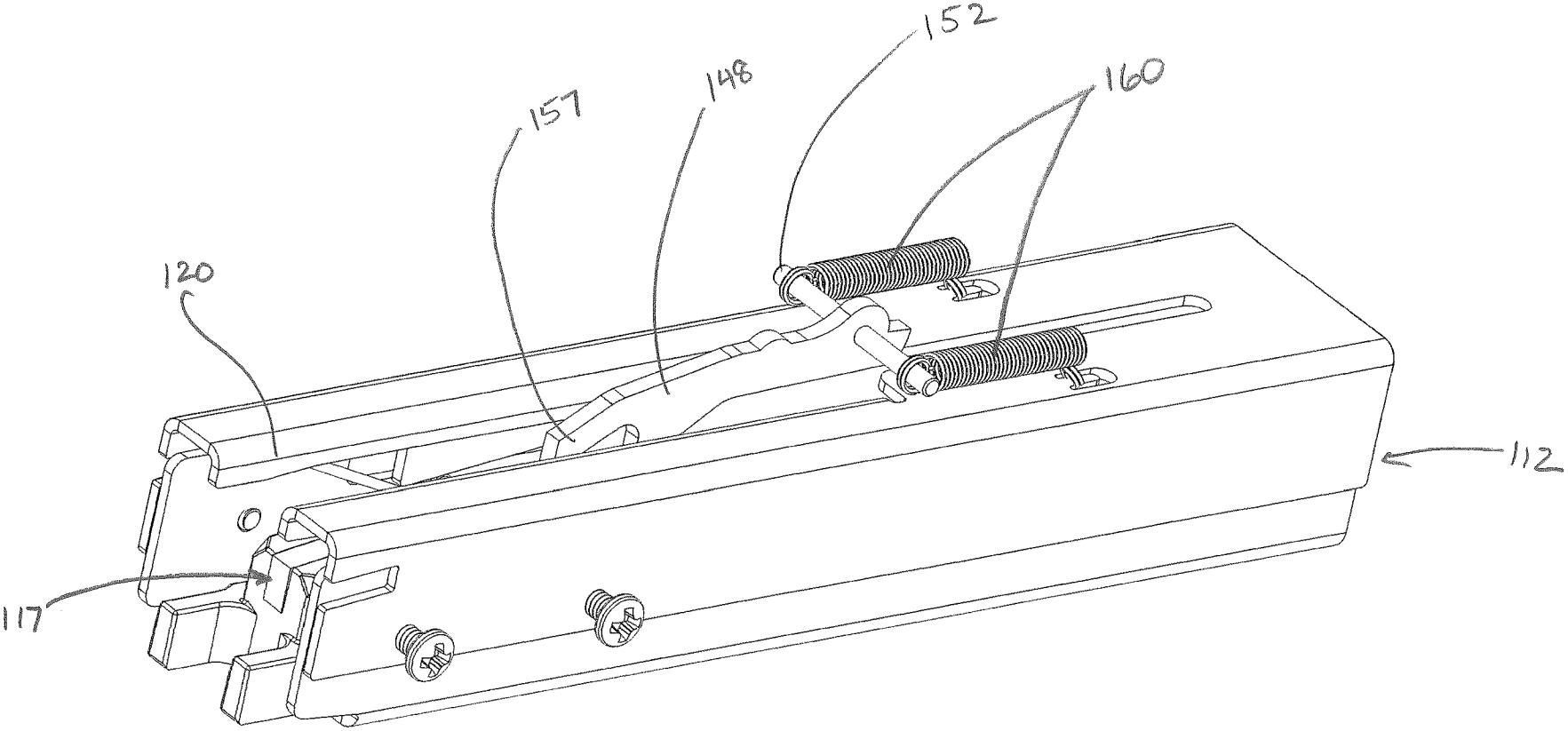
FIG. 18 is a perspective view of the lower portions of the guide of FIG. 16 with the advancement member and additional elements removed for clarity.

FIG. 18 shows a typical attachment of the pawl 148 via a substantially lateral pin 152 defining an axis of rotation. Typically, each end of the pin 152 is contained within an opening in the advancement member 114. In this embodiment, the pin 152 also maintains front ends of two springs 160. In operation, a user reciprocates the advancement member 114 forward against the compression spring bias to maintain a front-most fastener in position for attachment. After the fastener is attached, a user can release force on the advancement member and the springs 160 return to the compressed state, thereby automatically returning the advancement member 114 to its initial rearward position. As the advancement member 114 returns rearward under the bias from the springs 160, the pawl 148 passes over any additional fasteners in the track 112 via pivoting about the pin 152 against the downward bias from the compression spring 150. The pawl 148 holds a front fastener 100 in a strip against the front shoulders 132 via the trailing prong 155 abutting a trailing adjacent (second) fastener 100 in a strip (similar to the operation of the pawl 48 in the previous embodiments). When only a singular fastener 100 remains, the additional leading prong 157 allows the dual-prong pawl 148 to advance and cooperate with the torsion spring 135 to hold the single (last) fastener 100 in a strip against the front shoulders 132 in position for attachment with the last fastener 100 sandwiched between the torsion spring 135 and the upper shoulders 120 at the front end of the track 112.

Figure 19:
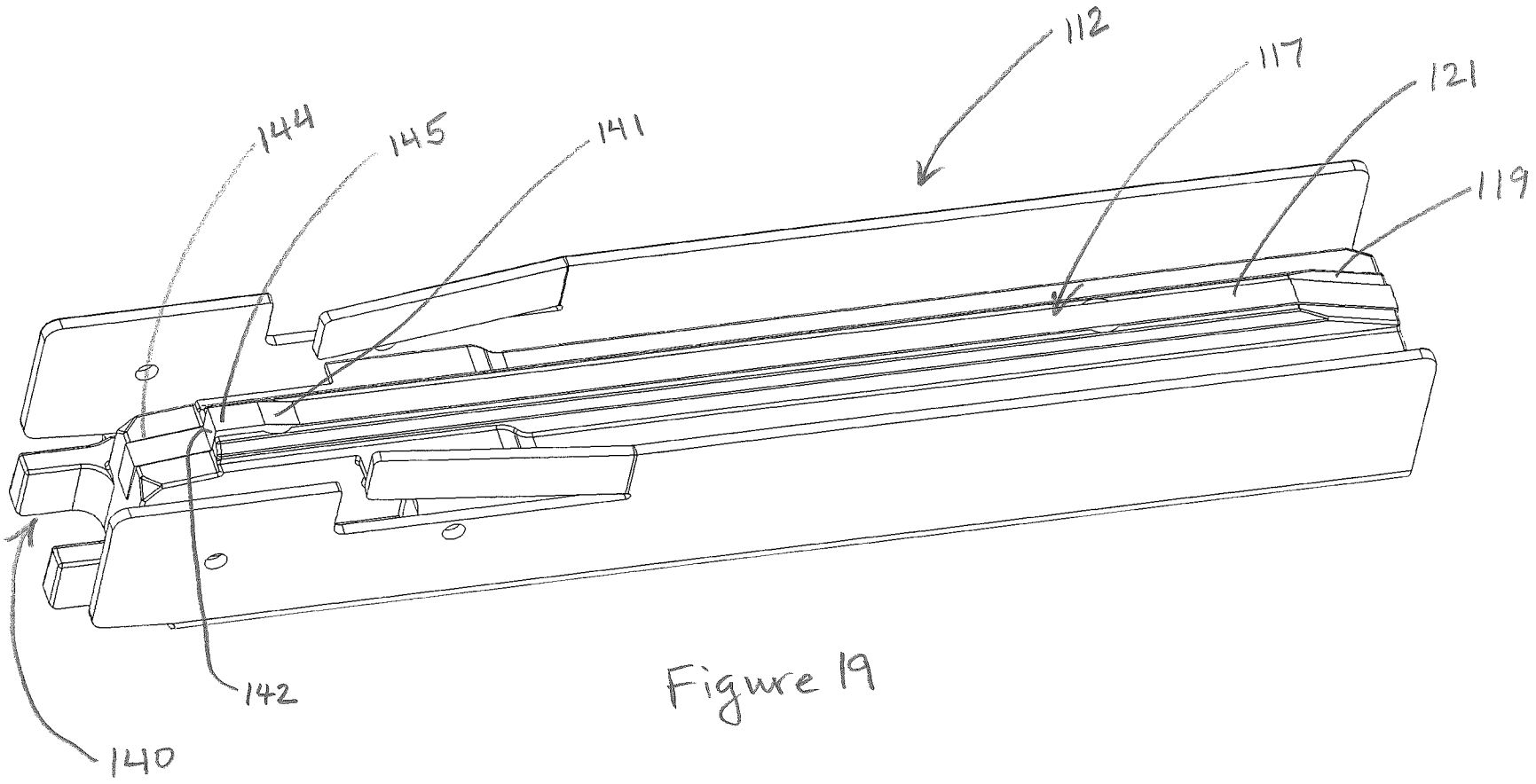
FIG. 19 is a perspective view of the track portion showing an alternate version of the rail.
Figure 20:
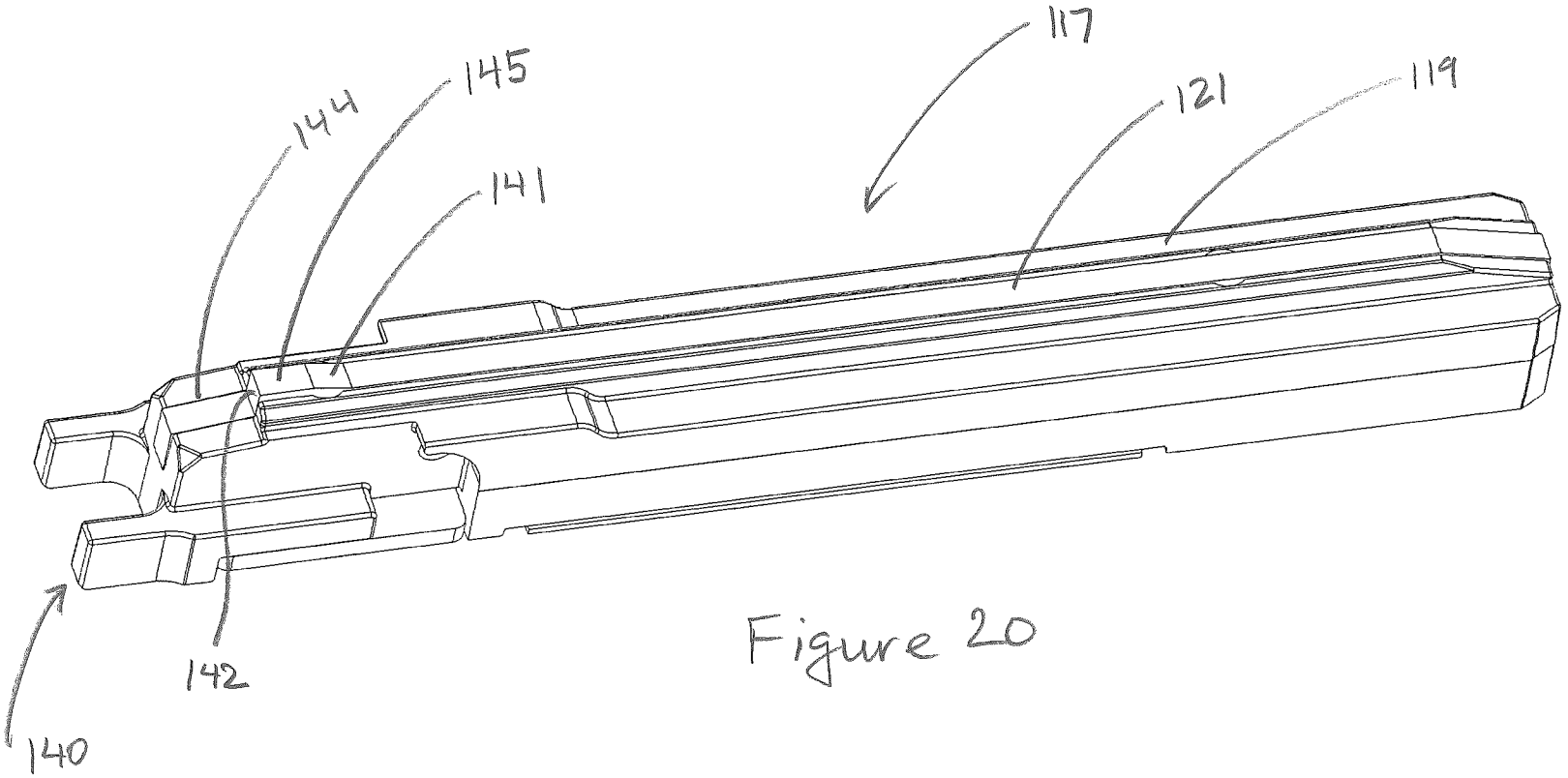
FIG. 20 is a perspective view of the rail of FIG. 19.

As shown in FIGS. 19 and 20, embodiments of the disclosed guide, such as reference numeral 101, include a track 112 with a rail 117 and an integrated front portion (as opposed to a separate anvil member discussed above). The front portion has the same characteristics as in the previous embodiments of the guide 10 and 10'; however it is formed as a single integrated unit within the rail 117. FIGS. 19 and 20 most clearly show the ramp 141 that transitions to an intermediate step or plateau 145 and a cliff 142 with a lower support ledge 144 forward of the cliff. Like the previous embodiments, the front defines a concave distal-most protrusion 140 for supporting the guide on a joist and accommodating a screw from the screw guide during installation.

The depicted embodiment of the rail 117 with integrated distal portion carrying the ramp 141, plateau 145, cliff 142 and ledge 144 is molded as a singular primary piece 119. The primary piece can be any strong, durable and moldable material, but is typically formed of a hard plastic. A central elongate unit 121 is positioned in the molded plastic primary piece 119. The central elongate unit 121 is typically formed of a metal, such as steel, and forms an abutment surface for the deck fasteners 100 during operation of the guide 101 (and/or 10 or 10') to advance and attach fasteners 100 to assemble the decking structure.

While a preferred embodiment has been set forth for purposes of illustration, the foregoing description should not be deemed a limitation of the invention herein. Accordingly, various modifications, adaptations and alternatives may occur to one skilled in the art without departing from the spirit of the invention and scope of the coverage.

What is claimed is:

1. A guide for advancing and installing a fastener via an elongate securing member, comprising:

an elongate track extending longitudinally from a rear end to a front end, the track comprising a substantially central elongate rail defining an advancement surface; and an advancement member engaged with and being longitudinally reciprocable along the track; wherein the advancement member includes a pawl extending from a rear edge to a front edge extending into the track, the pawl being maintained in a pivoting relationship relative to the advancement member about a substantially laterally extending axis, and the advancement member includes a stop proximate the rear edge of the pawl, the stop defining a rotational extent of the pawl in a single rotational direction, and the rail defines a substantially flat portion that transitions to a front cliff via an intermediate ramp.

2. The guide of claim 1, wherein front edge of the pawl is biased away from the advancement member toward the rail.

3. The guide of claim 1, wherein the pawl includes a leading prong defining a leading front edge extending to a leading terminal point and a trailing prong defining a trailing front edge extending to a trailing terminal point.

4. The guide of claim 3, wherein when the pawl is maintained against the stop, the trailing terminal point is closer than the leading terminal point to the advancement surface of the rail.

5. The guide of claim 3, wherein the leading prong includes a leading rear edge oblique to the leading front edge and the trailing prong includes a trailing rear edge oblique to the trailing front edge, and when the pawl is maintained against the stop, the leading and trailing front edges are substantially perpendicular to the longitudinal track.

6. The guide of claim 3, wherein the laterally extending axis is positioned longitudinally forward of the stop and a bias member is positioned longitudinally forward of the axis to bias the prongs toward the rail.

7. The guide of claim 1, comprising a screw guide positioned proximate the front end of the track for maintaining an elongate securing member in a substantially upright position.

8. The guide of claim 7, wherein the screw guide maintains an elongate securing member at an angle that is oblique to the rail in the rearward direction.

9. The guide of claim 8, wherein the elongate securing member is maintained by the screw guide at an approximate angle between 1° and 10° relative to an axis perpendicular to the rail.

10. The guide of claim 1, comprising a screw guide positioned proximate the front end of the track for maintaining an elongate securing member in a substantially upright position, wherein a frontmost fastener is maintained longitudinally forward of the cliff in an installation position substantially aligned with an upright securing member maintained by the screw guide.

11. The guide of claim 10, wherein the frontmost fastener is maintained in the installation position via an upward bias from a bias member.

12. The guide of claim 1, comprising:

a screw guide positioned proximate the front end of the track for maintaining an elongate securing member in a substantially upright position;

the pawl defines an engagement surface for engaging a fastener positioned along the rail in an intermediate position, and fasteners positioned within the track on the rail engage with the advancement when the advancement member is reciprocated forward along the track causing the fasteners to slide along the rail in a forward direction from the intermediate position to a forward position with a frontmost fastener in an installation position substantially aligned with a securing member maintained by the screw guide, and the advancement member disengages with fasteners positioned within the track when the advancement member is reciprocated rearward, thereby allowing the fasteners positioned within the track to remain in the intermediate or forward position.

13. The guide of claim 12, wherein the pawl engages a fastener when the advancement member is reciprocated forward and is pivotable about a substantially laterally extending axis via contact with a fastener when the advancement member is reciprocated rearward.

14. The guide of claim 12, wherein rail defines a front cliff and the advancement member maintains a frontmost fastener longitudinally forward of the cliff in the forward position.

15. The guide of claim 14, comprising a bias member for biasing the frontmost fastener in an upward direction away from the rail in the forward position.

16. The guide of claim 1, comprising a bias member for biasing a frontmost fastener in an upward direction away from the rail in an installation position forward of the cliff.

17. A guide for advancing and installing a fastener via an elongate securing member, comprising:

an elongate track extending longitudinally from a rear end to a front end, the track comprising a substantially central elongate rail defining an advancement surface; and an advancement member engaged with and being longitudinally reciprocable along the track;

a screw guide positioned proximate the front end of the track for maintaining an elongate securing member in a substantially upright position; and an upward bias member, wherein the advancement member includes a pawl extending from a rear edge to a front edge extending into the track, the pawl being maintained in a pivoting relationship relative to the advancement member about a substantially laterally extending axis, and the advancement member includes a stop proximate the rear edge of the pawl, the stop defining a rotational extent of the pawl in a single rotational direction, and a frontmost fastener defines an attachment opening and is maintained via the upward bias member in an installation position with the attachment opening substantially aligned with the securing member being maintained by the screw guide.

18. The guide of claim 17, wherein the bias member is a collapsed torsion spring.

19. The guide of claim 17, wherein the track comprises a pair of upper shoulders, and the bias member holds the frontmost fastener against the shoulders in the installation position.

20. The guide of claim 17, wherein the rail comprises a substantially flat portion that transitions to a front cliff via a ramp with a substantially flat plateau intermediate the ramp and the cliff.

21. The guide of claim 17, wherein the rail comprises a substantially flat portion that transitions to a front cliff via a ramp, comprising a pair of front shoulders forward of the cliff for providing a front stop against the frontmost fastener in the installation position.

22. The guide of claim 17, wherein the advancement surface transitions from a substantially flat portion to a front cliff and the installation position of the clip is longitudinally forward of the cliff.

* * * * *